US010513668B2

(12) United States Patent
Ransom et al.

(10) Patent No.: US 10,513,668 B2
(45) Date of Patent: Dec. 24, 2019

(54) DISPERSANT VISCOSITY INDEX IMPROVERS TO ENHANCE WEAR PROTECTION IN ENGINE OILS

(71) Applicant: Afton Chemical Corporation, Richmond, VA (US)

(72) Inventors: Paul Ransom, Marsden (GB); Guillaume Carpentier, Bracknell (GB)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 15/793,401

(22) Filed: Oct. 25, 2017

(65) Prior Publication Data

US 2019/0119602 A1 Apr. 25, 2019

(51) Int. Cl.
*C10M 169/04* (2006.01)
*C10M 159/12* (2006.01)

(52) U.S. Cl.
CPC ..... *C10M 169/045* (2013.01); *C10M 159/12* (2013.01); *C10M 169/048* (2013.01); *C10M 2203/1025* (2013.01); *C10M 2205/022* (2013.01); *C10M 2205/0285* (2013.01); *C10M 2207/028* (2013.01); *C10M 2217/06* (2013.01); *C10M 2219/046* (2013.01); *C10N 2210/02* (2013.01); *C10N 2210/06* (2013.01); *C10N 2220/021* (2013.01); *C10N 2230/02* (2013.01); *C10N 2230/04* (2013.01); *C10N 2230/06* (2013.01); *C10N 2230/40* (2013.01); *C10N 2230/42* (2013.01); *C10N 2230/45* (2013.01); *C10N 2230/68* (2013.01); *C10N 2240/10* (2013.01); *C10N 2240/102* (2013.01); *C10N 2240/103* (2013.01)

(58) Field of Classification Search
None
See application file for complete search history.

(56) References Cited

U.S. PATENT DOCUMENTS

| | | | |
|---|---|---|---|
| 3,178,663 | A | 4/1965 | Kahn |
| 3,185,647 | A | 5/1965 | Anderson et al. |
| 3,189,544 | A | 6/1965 | Ratner et al. |
| 3,256,185 | A | 6/1966 | Le Suer et al. |
| 3,256,530 | A | 6/1966 | Scott |
| 3,278,550 | A | 10/1966 | Norman et al. |
| 3,312,619 | A | 4/1967 | Dale |
| 3,366,569 | A | 1/1968 | Norman et al. |
| 3,390,086 | A | 6/1968 | O'Halloran |
| 3,403,102 | A | 9/1968 | Le Suer |
| 3,458,530 | A | 7/1969 | Siegel et al. |
| 3,502,677 | A | 3/1970 | Le Sner |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,654,370 | A | 4/1972 | Yeakey |
| 3,708,522 | A | 1/1973 | LeSuer |
| 3,749,695 | A | 7/1973 | de Vries |
| 3,839,318 | A | 10/1974 | Mansfield |
| 3,865,740 | A | 2/1975 | Goldschmidt |
| 3,865,813 | A | 2/1975 | Gergel |
| 3,954,639 | A | 5/1976 | Liston |
| 4,152,353 | A | 5/1979 | Habermann |
| 4,153,499 | A | 5/1979 | Boerzel et al. |
| 4,234,435 | A | 11/1980 | Meinhardt et al. |
| 4,259,194 | A | 3/1981 | deVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,272,387 | A | 6/1981 | King et al. |
| 4,283,295 | A | 8/1981 | deVries et al. |
| 4,285,822 | A | 8/1981 | deVries et al. |

(Continued)

FOREIGN PATENT DOCUMENTS

| | | | |
|---|---|---|---|
| EP | 0612839 | A1 | 8/1994 |
| EP | 2371934 | A1 | 10/2011 |

(Continued)

OTHER PUBLICATIONS

Extended EP Search Report; dated Mar. 6, 2019 for EP Application No. 18202436.4.

Afton Chemical Corporation, "HiTEC 5777," Jan. 1, 2011, XP055561256, Retrieved from the Internet on Feb. 25, 2019: http://www.aftonchemical.com/Afton/media/AftonSBU/Engine/PDS/HiTEC-5777/HiTEC-5777_PDS.pdf?ext=.pdf.

*Primary Examiner* — Vishal V Vasisth

(74) *Attorney, Agent, or Firm* — Mendelsohn Dunleavy, P.C.

(57) ABSTRACT

An engine oil composition including greater than 50 wt. % of a base oil of lubricating viscosity selected from a Group III, a Group IV or a Group V base oil, and mixtures thereof, 0.1-10 wt. % of a dispersant viscosity index improver that a reaction product of an olefin copolymer, an acylating agent and a polyamine, one or more calcium-containing detergents that provide from about 900 ppmw to about 2500 ppmw of calcium to the engine oil composition, and one or more molybdenum-containing compounds. The engine oil composition has an SAE viscosity grade of 0W-X or 5W-X, wherein X=16, 20, 30, or 40; from about 500 ppmw to about 1000 ppmw of phosphorus; and a total sulfated ash content of no greater than 1.2 wt. %, as measured by ASTM D874. Methods of using the engine oil composition to lubricate or operate an engine are also described.

22 Claims, No Drawings

(56) References Cited

U.S. PATENT DOCUMENTS

| | | | |
|---|---|---|---|
| 4,340,689 | A | 7/1982 | Joffrion |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,618,717 | A | 10/1986 | Renken et al. |
| 4,636,322 | A | 1/1987 | Nalesnik |
| 4,645,515 | A | 2/1987 | Wollenberg |
| 4,647,390 | A | 3/1987 | Buckley, III et al. |
| 4,648,886 | A | 3/1987 | Buckley, III et al. |
| 4,648,980 | A | 3/1987 | Erdman |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,670,515 | A | 6/1987 | Olivier |
| 4,699,724 | A | 10/1987 | Nalesnik et al. |
| 4,713,189 | A | 12/1987 | Nalesnik et al. |
| 4,713,191 | A | 12/1987 | Nalesnik |
| 4,766,245 | A | 8/1988 | Larkin et al. |
| 4,857,214 | A | 8/1989 | Papay et al. |
| 4,948,386 | A | 8/1990 | Sung et al. |
| 4,948,842 | A | 8/1990 | Olivier |
| 4,960,942 | A | 10/1990 | Gerkin et al. |
| 4,963,275 | A | 10/1990 | Gutierrez et al. |
| 4,963,278 | A | 10/1990 | Blain et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,973,761 | A | 11/1990 | Schoenleben et al. |
| 4,981,492 | A | 1/1991 | Blain et al. |
| 5,003,107 | A | 3/1991 | Zimmerman et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | Degonia et al. |
| 5,352,835 | A | 10/1994 | Dai et al. |
| 5,422,042 | A | 6/1995 | Waddill et al. |
| 5,457,147 | A | 10/1995 | McGrath et al. |
| 5,616,153 | A | 4/1997 | Mike et al. |
| 5,650,381 | A | 7/1997 | Gatto et al. |
| 6,107,207 | A | 8/2000 | Waas et al. |
| 6,107,257 | A | 8/2000 | Valcho et al. |
| RE37,363 | E | 9/2001 | Gatto et al. |
| 6,300,291 | B1 | 10/2001 | Hartley et al. |
| 6,528,461 | B1 | 3/2003 | Mike et al. |
| 6,723,685 | B2 | 4/2004 | Hartley et al. |
| RE38,929 | E | 1/2006 | Gatto et al. |
| RE40,595 | E | 12/2008 | Gatto et al. |
| 7,473,098 | B1 | 1/2009 | Poulos |
| 8,048,831 | B2 | 11/2011 | Loper |
| 8,093,189 | B2 | 1/2012 | Devlin et al. |
| 8,420,583 | B2 | 4/2013 | Boegner et al. |
| 2013/0172220 | A1 | 7/2013 | Ruhe, Jr. |
| 2015/0111797 | A1 | 4/2015 | Lyon et al. |
| 2017/0044460 | A1* | 2/2017 | Loop ..... C10M 169/045 |
| 2017/0073606 | A1* | 3/2017 | Galic Raguz ..... C10M 149/12 |

FOREIGN PATENT DOCUMENTS

| | | | |
|---|---|---|---|
| EP | 2990469 | A1 | 3/2016 |
| GB | 1065595 | | 4/1967 |
| GB | 2140811 | A | 12/1984 |
| GB | 2446277 | A | 8/2008 |
| WO | WO9406897 | A1 | 3/1994 |

* cited by examiner

DISPERSANT VISCOSITY INDEX IMPROVERS TO ENHANCE WEAR PROTECTION IN ENGINE OILS

TECHNICAL FIELD

The disclosure relates to engine oils containing a multi-functional olefin copolymer viscosity index improver. More specifically, the engine oil composition comprising the multi-functional olefin copolymer viscosity index improver may provide one or more of good thickening power, excellent dispersancy, improved soot handling, wear protection, and piston cleanliness.

BACKGROUND

The emphasis on fuel economy has been increased in recent years. One approach to improve the fuel economy of vehicles is to design new lubricant oils that reduce friction and have lower high-temperature high-shear ("HTHS") viscosity, while maintaining a good film thickness for durability. In an attempt to improve fuel economy and to reduce vehicle $CO_2$ emissions, the use and stipulation of low viscosity grades by the Original Equipment Manufacturer (OEM) is becoming increasingly widespread. In Europe, several OEMs are looking at 0W-xx and 5W-xx viscosity grades for passenger car gasoline and diesel vehicles. For example, Volkswagen (VW) and Bayerische Motoren Werke (BMW) have 0W-20 specifications. The BMW specification is known as LL-14FE+.

One of the challenges for the provision of engine oils having these reduced viscosity grades is maintaining engine cleanliness. Such engine oils must be able to reduce engine sludge and provide good soot handling, and wear protection, whilst providing desired fuel economy benefits. These targets should be achieved while maintaining low levels of sulphated ash and phosphorus, as well as ensuring seal compatibility. Viscosity index improvers ("VII's") play an important role in formulating engine oils with these desired properties. There is a need to provide new engine oils having low viscosity grades that meet these requirements.

Another challenge for these low viscosity grade engine oils is that some OEM's are requiring or will require that the engine oils pass the OM646LA engine wear test. Thus, in some cases the engine oil formulations must be suitable for passing the several requirements of this test.

With an increase in oil temperature, the viscosity of an engine oil generally decreases and with decreasing oil temperature, the viscosity of the oil generally increases. Modern engines typically operate at high temperatures. It is important to maintain the viscosity of the engine oil within a specified range while the engine is operating at these high temperatures to properly lubricate moving parts of the engine. Additionally, the engine oils may be exposed to low temperatures from the environment when the engine is not running. Under these conditions, the viscosity of the oil must remain low enough so that the oil will flow at the temperatures encountered under engine starting conditions. Acceptable oil viscosity ranges for various temperatures are specified by the SAE J300 standard.

Engine oils also encounter high shear rates when used in engines. Shear rates as high as $10^6$ $s^{-1}$ have been reported in literature. The viscosity behavior of lubricants under high temperature high shear (HTHS) conditions may have an impact on fuel economy. Fluids with relatively high HTHS viscosities typically exhibit poor fuel economy due to the formation of a thicker oil film at the boundaries of the engine surfaces during engine operation. In contrast, fluids with relatively low HTHS viscosities may form a thinner oil film thereby providing improved fuel economy.

Base oils typically do not meet the viscosity requirements of SAE J300 without the addition of additives such as VIIs. VIIs may be used to reduce the extent to which the viscosity of lubricants changes with temperature, and are often used to formulate oils that meet the SAE J300 standard. Suitable VIIs typically include polymeric materials that may be derived from ethylene-propylene copolymers, polymethacrylates, hydrogenated styrene-butadiene copolymers, polyisobutylenes, etc.

Ethylene-propylene copolymers are often used as VIIs for engine oils. The ethylene content of such copolymers may range from 45 to 85 mole %. VIIs derived from such copolymers containing 60 mole % ethylene are commonly used and require a relatively high treat rate in oils in order to meet SAE J300 requirements. VIIs derived from such copolymers containing higher than about 65 mole % ethylene to 85 mole % ethylene generally require a lower treat rate in oils in order to meet SAE J300 requirements than those containing about 60 mole percent of ethylene due to their greater thickening power.

US 2013/0172220 A1 relates to additives for lubricating oil compositions which are the reaction products of: (a) an oil soluble ethylene-alpha olefin copolymer comprising 10 to less than 80 wt. % of ethylene and greater than 20 up to 90 wt. % of at least one $C_3$-$C_{28}$ alpha olefin. The copolymer has a number average molecular weight of from about 5,000 to 120,000 and is reacted or grafted with 0.5-5.0 weight percent of an ethylenically unsaturated acylating agent having at least one carboxylic acid or anhydride group, and reacted with (b) a hydrocarbyl substituted poly(oxyalkylene) monoamine of the formula:

$$R_1—(O—CHR_2—CHR_2)_x\text{-}A$$

wherein $R_1$ is a hydrocarbyl group having from about 1 to about 35 carbon atoms; $R_2$ and $R_3$ are each independently hydrogen, methyl or ethyl; A is amino, —$CH_2$-amino or N-alkyl amino having about 1-10 carbon atoms and x is an integer of from 2 to about 45.

U.S. Pat. No. 6,107,257 relates to additives for lubricating oil compositions that comprise multi-functional olefin copolymer viscosity index improvers. Maleic anhydride is reacted or grafted onto an ethylene-propylene copolymer backbone in the presence of a solvent and then the grafted copolymer is reacted with a polyamine such as an N-arylphenylene diamine in the presence of a surfactant to provide the multi-functional olefin copolymer viscosity index improver. Examples I and II exemplify highly grafted multi-functional olefin copolymers which are said to exhibit reduced boundary friction and improve fuel economy.

U.S. Pat. No. 6,528,461 relates to an oil of lubricating viscosity including a polymeric ethylene-alpha-olefin copolymer derived dispersant and a molybdenum compound. The ethylene-alpha-olefin copolymer dispersant is said to provide improved boundary friction properties. Examples 2A-2D employ a dispersant made by grafting maleic anhydride onto an ethylene-propylene copolymer and subsequently reacting the grafted copolymer with N-phenyl-1,4-phenylenediamine (NPPDA).

U.S. Pat. No. 8,093,189 relates to lubricating oil compositions that contain effective amounts of certain olefin copolymer dispersant viscosity index improvers that inhibit coolant-induced oil filter plugging in heavy-duty diesel engines. Example 1 of the patent, discloses a lubricating oil containing an ethylene-propylene copolymer reacted or grafted with maleic anhydride and subsequently reacted with N-phenyl-1,4-phenylenediamine.

There remains a need to provide alternative or improved engine oil compositions that meet the SAE J300 standards and pass the OM646LA engine wear test, while also providing improved fuel economy. The present invention provides engine oil compositions including grafted, multifunctional olefin copolymers that pass the OM646LA engine wear test and can provide one or more of improved wear protection, improved fuel economy, as well as acceptable soot handling, and/or engine cleanliness.

SUMMARY AND TERMS

As set forth above, the present disclosure relates to an engine oil composition comprising:

a) greater than 50 wt. % of a base oil of lubricating viscosity, wherein the base oil comprises of a Group III, Group IV, and Group V base oil, or mixtures thereof; and b) 0.1-10 wt. % of a dispersant viscosity index improver, based on a total weight of the engine oil composition, wherein the dispersant viscosity index improver is a reaction product of an olefin copolymer and an acylating agent and a polyamine;

c) one or more calcium-containing detergents, wherein the one or more calcium-containing detergents provides from about 900 ppmw to about 2500 ppmw of calcium to the engine oil composition, based on the total weight of the engine oil composition;

d) one or more molybdenum-containing compounds; and wherein the engine oil composition has an SAE viscosity grade of 0W-X or 5W-X, and X=16, 20, 30, or 40; from about 500 ppmw to about 1000 ppmw of phosphorus; and a total sulfated ash content of no greater than 1.2 wt. %, as measured by ASTM D874, both based on a total weight of the engine oil composition.

In the foregoing embodiment, the engine oil composition may further comprise a nitrogen-containing dispersant or up to 10 wt. % of a nitrogen-containing dispersant, based on a total weight of the engine oil composition.

In each of the foregoing embodiments, the engine oil composition may have a ratio of total metal from detergents to total nitrogen from dispersants of less than 2.5. In each of the foregoing embodiments, the ratio of total metal from detergents to total nitrogen from dispersants may be less than 2.0

In each of the foregoing embodiments the one or more calcium-containing detergents may provide from about 1000 ppmw to about 2200 ppmw of calcium to the engine oil composition, based on the total weight of the engine oil composition. In each of the foregoing embodiments, the one or more calcium-containing detergents may provide from about 1100 ppmw to about 2000 ppmw of calcium to the engine oil composition, based on the total weight of the engine oil composition.

In each of the foregoing embodiments, the calcium-containing detergent may comprise an amount of calcium phenate sufficient to deliver at least 300 ppmw of calcium to the engine oil composition, or at least 350 ppmw of calcium, or at least 400 ppmw of calcium, or at least 500 ppmw of calcium to the engine oil composition, based on the total weight of the engine oil composition.

In each of the foregoing embodiments, the base oil may comprise a Group III base oil, a Group IV base oil, or a mixture thereof.

In each of the foregoing embodiments, the acylating agent may be an ethylenically unsaturated acylating agent having at least one carboxylic acid or anhydride group. In each of the foregoing embodiments, the acylating agent may be maleic anhydride.

In each of the foregoing embodiments, the polyamine may be an N-arylphenylene diamine of the formula I:

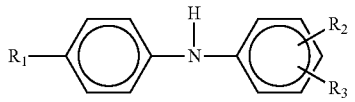

I wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms.

In each of the foregoing embodiments, the polyamine may be selected from the group consisting of N-phenyl-1,4-phenylenediamine, N-phenyl-1,3-phenyldiamine, and N-phenyl-1,2-phenylenediamine.

In each of the foregoing embodiments, the olefin copolymer may be a copolymer of ethylene and one or more $C_3$-$C_{28}$ alpha olefins. In each of the foregoing embodiments, the copolymer may be a copolymer of ethylene and one or more $C_3$-$C_{28}$ alpha olefins, the copolymer may have a number average molecular weight of 5,000 to 150,000 amu and/or the copolymer may comprise 10-80 wt. % of ethylene and 20-90 wt. % of the one or more $C_3$-$C_{28}$ alpha olefins, each based on the total weight of the engine oil composition. In each of the foregoing embodiments, the copolymer of ethylene and one or more $C_3$-$C_{28}$ alpha olefin may contain 0.14 to 6.86 carboxylic groups per 1000 number average molecular weight units of the polymer backbone.

In each of the foregoing embodiments, the engine oil composition may further comprise no greater than 10 wt. % of at least one dispersant, based on the total weight of the engine oil composition.

In each of the foregoing embodiments, the engine oil composition may have a total sulfur content of no greater than 0.03 wt. %, based on the total weight of the engine oil composition.

In each of the foregoing embodiments, the engine oil composition may further comprise one or more components selected from the group consisting of friction modifiers, antiwear agents, antioxidants, antifoam agents, process oil, and pour point depressants.

In each of the foregoing embodiments, the engine oil composition may not contain an additional viscosity index improver other than the dispersant viscosity index improver of claim 1.

In each of the foregoing embodiments, the engine oil composition may not contain a friction modifier.

In each of the foregoing embodiments, the calcium-containing detergent may comprise a mixture of calcium-containing detergents wherein greater than 50 wt. % of the mixture is a calcium sulfonate detergent, based on the total weight of the calcium-containing detergents.

In each of the foregoing embodiments, the engine oil composition may comprise from about 0.1 wt. % to about 5 wt. % of the dispersant viscosity index improver, based on the total weight of the engine oil composition.

The present invention also generally relates to a method for improving wear protection in an engine comprising a step of lubricating said engine with an engine oil composition comprising:

greater than 50 wt. % of a base oil of lubricating viscosity, based on the total weight of the engine oil composition; and an additive composition including:

a) 0.1-20 wt. % of a dispersant viscosity index improver, based on a total weight of the engine oil composition, wherein the dispersant viscosity index improver is the reaction product of an olefin copolymer, an acylating agent and a polyamine; and b) one or more calcium-containing detergents, wherein the one or more calcium-containing detergents provides at least 900 ppmw of calcium to the engine oil composition, based on the total weight of the engine oil composition; and wherein the engine oil composition has an SAE viscosity grade from 0W or 5W, from about 50 ppmw to about 1000 ppmw of phosphorus, and a total sulfated ash content of no greater than 1.2 wt. % as measured by ASTM D874, both based on the total weight of the engine oil composition.

The present invention also generally relates to a method of operating an engine comprising step of lubricating the engine with an engine oil composition comprising:

greater than 50 wt. % of a base oil of lubricating viscosity, based on the total weight of the engine oil composition; and an additive composition including:

a) 0.1-20 wt. % of a dispersant viscosity index improver, based on a total weight of the engine oil composition, wherein the dispersant viscosity index improver is the reaction product of an olefin copolymer, an acylating agent and a polyamine; and b) one or more calcium-containing detergents, wherein the one or more calcium-containing detergents provides at least 900 ppmw of calcium to the engine oil composition, based on the total weight of the engine oil composition; and wherein the engine oil composition has an SAE viscosity grade from 0W or 5W, from about 50 ppmw to about 1000 ppmw of phosphorus, and a total sulfated ash content of no greater than 1.2 wt. %, as measured by ASTM D874, both based on the total weight of the engine oil composition; and operating the engine.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished engine oil product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the engine oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic moiety);

(b) substituted hydrocarbon substituents, that is, substituents containing non-hydrocarbon groups which, in the context of this disclosure, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain other than carbon in a ring or chain otherwise composed of carbon atoms. Heteroatoms may include sulfur, oxygen, and nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739 or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

The term "copolymer" as employed herein . . . .

The terms "essentially free of" is meant to include minor amounts of an element or compound, such as inevitable impurities which might lead to the presence of one or more such elements or compounds, but these are not present in amounts that affect the novel and basic characteristic of the present disclosure.

Engine oils, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubrited coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

To ensure smooth operation of engines, engine oils play an important role in lubricating a variety of sliding parts in the engine, for example, piston rings/cylinder liners, bearings of crankshafts and connecting rods, valve mechanisms including cams and valve lifters, and the like. Engine oils may also play a role in cooling the inside of an engine and dispersing combustion products. Further possible functions of engine oils may include preventing or reducing rust and corrosion.

The principle consideration for engine oils is to prevent wear and seizure of parts in the engine. Lubricated engine parts are mostly in a state of fluid lubrication, but valve systems and top and bottom dead centers of pistons are likely to be in a state of boundary and or thin-film lubrication. The friction between these parts in the engine may cause significant energy losses and thereby reduce fuel efficiency.

The engine oil composition for an internal combustion engine may be suitable for any engine lubricant irrespective of the sulfur, phosphorus, or sulfated ash (ASTM D-874) content. The sulfur content of the engine oil lubricant may be about 1 wt. % or less, or about 0.8 wt. % or less, or about 0.5 wt. % or less, or about 0.3 wt. % or less, or about 0.2 wt. % or less. In one embodiment the sulfur content may be in the range of about 0.001 wt. % to about 0.5 wt. %, or about 0.01 wt. % to about 0.3 wt. %. The phosphorus content may be about 0.2 wt. % or less, or about 0.1 wt. % or less, or about 0.085 wt. % or less, or about 0.08 wt. % or less, or even about 0.06 wt. % or less, about 0.055 wt. % or less, or about 0.05 wt. % or less. In one embodiment the phosphorus content may be about 50 ppm to about 1000 ppm, or about 325 ppm to about 850 ppm, or about 450 ppm to about 820 ppm. The total sulfated ash content may be about 2 wt. % or less, or about 1.5 wt. % or less, or about 1.1 wt. % or less, or about 1 wt. % or less, or about 0.8 wt. % or less, or about 0.5 wt. % or less. In one embodiment the sulfated ash content may be about 0.05 wt. % to about 1.2 wt. %, or about 0.1 wt. % or about 0.2 wt. % to about 0.45 wt. %. In another embodiment, the sulfur content may be about 0.4 wt. % or less, the phosphorus content may be about 0.08 wt. % or less, and the sulfated ash is about 1.2 wt. % or less. In yet another embodiment the sulfur content may be about 0.3 wt. % or less, the phosphorus content is about 0.08 wt. % or less, and the sulfated ash may be about 0.8 wt. % or less.

In one embodiment the engine oil composition may have (i) a sulfur content of about 0.5 wt. % or less, (ii) a phosphorus content of about 0.08 wt. % or less, and (iii) a sulfated ash content of about 1.2 wt. % or less.

In one embodiment the engine oil composition is suitable for a 2-stroke or a 4-stroke marine diesel internal combustion engine. In one embodiment the marine diesel combustion engine is a 2-stroke engine. In some embodiments, the engine oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the engine oil composition is suitable for use with engines powered by low sulfur fuels, such as fuels containing less than 500 ppm sulfur, less than 80 ppm sulfur, less than 50 ppm sulfur, less than 15 ppm sulfur, or less than 10 ppm sulfur.

Low speed diesel typically refers to marine engines, medium speed diesel typically refers to locomotives, and high speed diesel typically refers to highway vehicles. The engine oil composition may be suitable for only one of these types or all.

Further, lubricants of the present description may be suitable to meet one or more industry specification requirements such as ILSAC GF-3, GF-4, GF-5, GF-6, PC-11, CF, CF-4, CH-4, CI-4, CJ-4, API SG, SJ, SL, SM, SN, ACEA A1/B1, A2/B2, A3/B3, A3/B4, A5/B5, C1, C2, C3, C4, C5, E4/E6/E7/E9, Euro 5/6, Jaso DL-1, Low SAPS, Mid SAPS, or original equipment manufacturer specifications such as Dexos™ 1, Dexos™ 2, MB-Approval 229.1, 229.3, 229.5, 229.31, 229.51, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Porsche A40, C30, Peugeot Citroen Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, 51, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122 or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, or lubricating, are designed to meet specific and stringent manufacturer requirements.

The present disclosure provides novel engine oil blends formulated for use as automotive crankcase lubricants. The present disclosure provides novel engine oil blends formulated for use as 2 T and/or 4 T motorcycle crankcase lubricants. Embodiments of the present disclosure may provide engine oils suitable for crankcase applications and having improvements in the following characteristics: air entrainment, alcohol fuel compatibility, antioxidancy, anti-wear performance, biofuel compatibility, foam reducing properties, friction reduction, fuel economy, pre-ignition prevention, rust inhibition, sludge and/or soot dispersability, piston cleanliness, deposit formation, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

The disclosure provides viscosity index improvers (VIIs) and engine oil compositions comprising these VIIs. The VIIs used in the present disclosure may be multi-functional. Also, the VIIs are sometimes employed to improve fuel economy of an engine relative to the same engine operated with the same lubticating oil composition in the absence of the VII of the present disclosure. The VII may be used to provide an acceptable the high-temperature high shear ("HTHS") viscosity, and maintain a desirable film thickness of a lubricating oil in use under expected operating conditions. The VIIs described herein may also provide an enhancement of fuel economy, reduce friction, as well as having good thickening properties when employed in engine oils.

The disclosure also provides engine oil compositions containing grafted olefin copolymer VIIs which may be multi-functional, as well as methods of using engine oil compositions containing the grafted olefin copolymers to provide improved engine operational performance and better fuel economy.

The engine oil composition includes a base oil and the dispersant viscosity index improver, and may optionally contain one or more additional additives known to be useful in engine oil compositions, as discussed in further detail below. The dispersant viscosity index improver is a grafted olefin copolymer. The grafted olefin copolymer, when formulated in the engine oil composition, may provide an acceptable HTHS viscosity, may help to maintain a good film thickness and may also improve soot dispersancy. It is believed that one or more of these beneficial properties or a combination thereof may increase the fuel economy of an engine in which the engine oil is used.

Dispersant Viscosity Index Improver

The dispersant viscosity index improver of the disclosure is an olefin copolymer comprising ethylene and one or more $C_3$-$C_{28}$ alpha olefins, reacted or grafted with an acylating agent and reacted with one or more polyamines.

In order to provide the grafted copolymer of ethylene and one or more $C_3$-$C_{28}$ alpha olefins, the copolymer, of ethylene and one or more $C_3$-$C_{28}$ alpha olefins is first reacted or grafted with an acylating agent to produce the grafted copolymer of ethylene and one or more $C_3$-$C_{28}$ alpha olefins.

In an embodiment, the dispersant viscosity index improver may be present in the engine oil composition an amount of from about 0.1 wt. % to about 20 wt. %, based on the total weight of the engine oil composition. In another embodiment, the dispersant viscosity index improver is present in the engine oil composition in an amount of from about 0.1 wt. % to about 10 wt. %, or from about 0.1 wt. % to about 5 wt. %, based on the total weight of the engine oil composition. In a preferred embodiment, the dispersant viscosity index improver is present in the engine oil composition in an amount of about 0.5 to about 8 wt. %, or from about 1 to about 5 wt. %, based on the total weight of the engine oil composition.

The Copolymer

The copolymer employed to make the dispersant viscosity index improver may be prepared from ethylene and at least one $C_3$ to $C_{28}$ alpha-olefin. Copolymers of ethylene and propylene are most preferred. Other alpha-olefins suitable for use in place of propylene to form the copolymer or to be used in combination with ethylene and propylene include 1-butene, 1-pentene, 1-hexene, 1-octene and styrene; $\alpha,\omega$-diolefins such as 1,5-hexadiene, 1,6-heptadiene, 1,7-octadiene; branched chain alpha-olefins such as 4-methylbutene-1,5-methylpentene-1 and 6-methylheptene-1; and mixtures thereof. Also, the copolymers may contain ethylene and any number of $C_3$ to $C_{28}$ alpha-olefins and thus may include terpolymers of ethylene, propylene and one or more $C_4$ to $C_{28}$ alpha-olefins.

More complex polymer substrates, often designated as interpolymers, may be prepared using at least a third component. The third component that may be used to prepare an interpolymer substrate is a polyene monomer selected from non-conjugated dienes and trienes. The-non-conjugated diene component is one having from 5 to 14 carbon atoms in the chain. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norborene, 1,5-heptadiene, and 1,6-octadiene. A mixture of more than one diene can be used in the preparation of the interpolymer. A preferred non-conjugated diene for preparing a terpolymer or interpolymer substrate is 1,4-hexadiene.

The triene component will have at least two non-conjugated double bonds, and up to about 30 carbon atoms in the chain. Typical trienes useful in preparing the interpolymer of the invention are 1-isopropylidene-3$\alpha$,4,7,7$\alpha$-tetrahydroindene, 1-isopropylidenedicyclopentadiene, dihydro-isodicyclopentadiene, and 2-(2-methylene-4-methyl-3-pentenyl) [2.2.1] bicyclo-5-heptene.

Ethylene-propylene or higher alpha-olefin copolymers may consist of from about 10 to 80 mole percent ethylene and from about 90 to 20 mole percent $C_3$ to $C_{28}$ alpha-olefin with the preferred mole ratios being from about 35 to 75 mole percent ethylene and from about 65 to 25 mole percent of a $C_3$ to $C_{28}$ alpha-olefin, with the more preferred proportions being from 50 to 70 mole percent ethylene and 50 to 30 mole percent $C_3$ to $C_{28}$ alpha-olefin, and the most preferred proportions being from 55 to 65 mole percent ethylene and 45 to 35 mole percent $C_3$ to $C_{28}$ alpha-olefin.

Terpolymer variations of the foregoing polymers may contain from about 0.1 to 10 mole percent of a non-conjugated diene or triene.

The ethylene copolymer or terpolymer, is an oil-soluble, linear or branched copolymer having a number average molecular weight of from about 5,000 g/mol. to 150,000 g/mol. as determined by gel permeation chromatography and universal calibration standardization, with a preferred number average molecular weight range of 20,000 g/mol. to 120,000 g/mol. or a more preferred number average molecular weight range of 30,000 g/mol. to 110,000 g/mol.

The terms polymer and copolymer are used generically to encompass ethylene copolymers, terpolymers or interpolymers. These materials may contain minor amounts of other olefinic monomers so long as the basic characteristics of the copolymers are not materially changed.

The polymerization reaction used to form the ethylene-olefin copolymer is generally carried out in the presence of a conventional Ziegler-Natta or metallocene catalyst system. The polymerization medium is not critical and thus the polymerization process can include solution, slurry, or gas phase processes, as known to those skilled in the aft. When solution polymerization is employed, the solvent may be any suitable inert hydrocarbon solvent that is liquid under reaction conditions for polymerization of alpha-olefins. Examples of satisfactory hydrocarbon solvents include straight chain paraffins having from 5 to 8 carbon atoms, with hexane being preferred. Aromatic hydrocarbons, preferably aromatic hydrocarbons having a single benzene nucleus, such as benzene, toluene and the like may also be used. Also, saturated cyclic hydrocarbons having boiling point ranges approximating those of the straight chain paraffinic hydrocarbons and aromatic hydrocarbons described above, are particularly suitable. The solvent may be a mixture of one or more of the foregoing hydrocarbons. When slurry polymerization is employed, the liquid phase for polymerization is preferably liquid propylene. It is desirable that the polymerization medium be free of substances that will interfere with the activity of the catalyst components.

Acylating Agent

An ethylenically unsaturated carboxylic acid material is reacted or grafted onto the copolymer to form an acylated ethylene copolymer. Carboxylic reactants which are suitable for grafting onto the ethylene copolymer contain at least one ethylenic bond and at least one, preferably two, carboxylic acid or anhydride groups or a polar group which is convertible into a carboxyl group by oxidation or hydrolysis. Preferably, the carboxylic reactants are selected from the group consisting of acrylic, methacrylic, cinnamic, crotonic, maleic, fumaric and itaconic reactants. More preferably, the carboxylic reactants are selected from the group consisting of maleic acid, fumaric acid, maleic anhydride, or a mixture of two or more of these. Maleic anhydride or a derivative thereof is generally most preferred due to its commercial availability and ease of reaction. In the case of unsaturated ethylene copolymers or terpolymers, itaconic acid or its anhydride is preferred due to its reduced tendency to form a cross-linked structure during the free-radical grafting process.

The ethylenically unsaturated carboxylic acid materials typically can provide one or two carboxylic groups per mole of reactant to the grafted polymer. For example, methyl methacrylate can provide one carboxylic group per molecule to the grafted polymer while maleic anhydride can provide two carboxylic groups per molecule to the grafted polymer.

The carboxylic reactant is reacted or grafted onto the prescribed polymer backbone in an amount to provide from about 0.14 to about 6.86 carboxylic groups per 1000 number average molecular weight units of the polymer backbone. As another example, the carboxylic reactant is reacted or grafted onto the prescribed polymer backbone in an amount to provide from about 0.15 to about 1.4 carboxylic groups per 1000 number average molecular weight units of the polymer backbone. As further example, the carboxylic reactant is reacted or grafted onto the prescribed polymer backbone in an amount to provide from about 0.3 to about 0.75 carboxylic groups per 1000 number average molecular weight units of the polymer backbone. As an even further example, the carboxylic reactant is reacted or grafted onto the prescribed polymer backbone in an amount to provide from about 0.3 to about 0.5 carboxylic groups per 1000 number average molecular weight units of the polymer backbone.

For example, a copolymer substrate with an Mn of 20,000 g/mol. may be reacted or grafted with 6 to 15 carboxylic groups per polymer chain or 3 to 7.5 moles of maleic anhydride per mole of copolymer. A copolymer with an Mn of 100,000 g/mol. may be reacted or grafted with 30 to 75 carboxylic groups per polymer chain or 15 to 37.5 moles of maleic anhydride per polymer chain. The minimum level of functionality is the level needed to achieve the minimum satisfactory dispersancy. Above the maximum functionalization level little, if any, additional dispersancy is noted and other properties of the additive may be adversely affected.

The grafting reaction to form the acylated olefin copolymers is generally carried out with the aid of a free-radical initiator either in solution or in bulk, as in an extruder or intensive mixing device. In some cases, it may be economically desirable to carry out the grafting reaction in hexane as described in U.S. Pat. Nos. 4,340,689, 4,670,515 and 4,948,842. The resulting grafted copolymer is characterized by having carboxylic acid acylating functionalities randomly distributed within its structure.

In the bulk process for forming the acylated olefin copolymers, the olefin copolymer fed to rubber or plastic processing equipment such as an extruder, intensive mixer or masticator, heated to a temperature of 150° C. to 400° C. and the ethylenically unsaturated carboxylic acid reagent and free-radical initiator may then be separately co-fed to the molten polymer to effect grafting. The reaction is optionally carried out with mixing condition to effect shearing and grafting of the ethylene copolymers according to, for example, the method of U.S. Pat. No. 5,075,383. The processing equipment is generally purged with nitrogen to prevent oxidation of the polymer and to aid in venting unreacted reagents and byproducts of the grafting reaction. The residence time in the processing equipment is sufficient to provide for the desired degree of acylation and to allow for purification of the acylated copolymer via venting. Mineral or synthetic engine oil may optionally be added to the processing equipment after the venting stage to dissolve the acylated copolymer.

Other methods known in the art for effecting reaction of ethylene-olefin copolymers with ethylenically unsaturated carboxylic reagents are described, for example, in U.S. Pat. No. 6,107,207.

Acylation Reactions

The acylated copolymer may be combined with oil and reacted with one or more polyamines. The one or more polyamine compounds may be:

an N-arylphenylenediamine represented by the formula

I

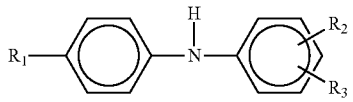

wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms;

(b) an aminothiazole selected from the group consisting of aminothiazole, aminobenzothiazole, aminobenzo-thiadiazole and aminoalkylthiazole;

(c) an aminocarbazole represented by the formula:

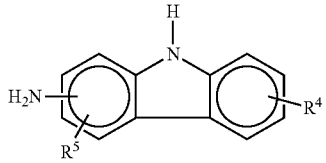

in which $R^4$ and $R^5$ represent hydrogen or an alkyl, alkenyl or alkoxyl radical having from 1 to H carbon atoms;

(d) an aminoindole represented by the formula:

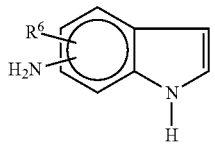

in which $R^6$ represents hydrogen or an alkyl radical having from 1 to 14 carbon atoms;

(e) an aminopyrrole represented by the formula:

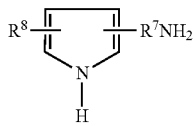

in which $R^7$ is a divalent alkylene radical having 2-6 carbon atoms and $R^8$ is hydrogen or an alkyl radical having from 1 to 14 carbon atoms;

(f) an amino-indazolinone represented by the formula:

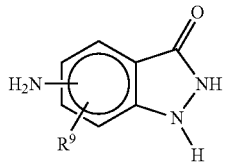

in which $R^9$ is hydrogen or an alkyl radical having from 1 to 14 carbon atoms;

(g) an aminomercaptotriazole represented by the formula:

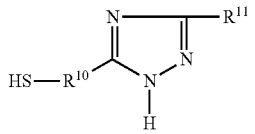

in which $R^{10}$ can be absent or is a $C_1$-$C_{10}$ linear or branched hydrocarbylene selected from the group consisting of alkylene, alkenylene, arylalkylene, or arylene; and $R^{11}$ is hydrogen or a $C_1$-$C_{14}$ alkyl, alkenyl, aralkyl or aryl group;

(h) an aminoperimidine represented by the formula,

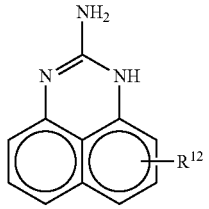

in which $R^{12}$ represents hydrogen or an alkyl or alkoxy radical having from 1 to 14 carbon atoms;

(i) aminoalkyl imidazoles such as 1-(2-aminoethyl)imidazole, 1-(3-aninopropyl) imidazole; and/or (j) aminoalkyl morpholines such as 4-(3-aminopropyl) morpholine.

Once this reaction is complete, a hydrocarbyl substituted poly(oxyalkylene) monoamine of the formula (I) is added to the composition and allowed to react with the product of the reaction of the grafted acylated copolymer and the polyamine(s). The result is an acylated olefin (co)polymer reacted or grafted with hydrocarbyl substituted poly(oxyalkylene) monoamine and a polyamine(s) such as N-arylphenylene diamine. It is also possible to carry out the steps of this reaction in the reverse order, if desired.

Hydrocarbyl Substituted Poly(Oxyalkylene) Monoamine

The hydrocarbyl substituted poly(oxyalkylene) monoamine may be represented by the formula (I):

$$R_{13}—(O—CHR_{14}—CHR_{15})_x\text{-}A$$

wherein $R_{13}$ is a hydrocarbyl group having from about 1 to about 35 carbon atoms; $R_{14}$ and $R_{15}$ are each independently hydrogen, methyl, or ethyl and each $R_{14}$ and $R_5$ are independently selected in each —O—$CHR_{14}$—$CHR_{15}$— unit; A is amino, —$CH_2$-amino or N-alkyl amino having about 1 to about 10 carbon atoms; and x is an integer from about 2 to about 45. Methods for the preparation of the hydrocarbyl substituted poly(oxyalkylene) monoamines are disclosed in US 2013/0172220 A1.

Particularly suitable hydrocarbyl substituted poly(oxyalkylene) monoamines include those wherein $R_{13}$ is selected from the group consisting of alkyl, aryl, alkyaryl, arylalkyl, and arylalkylaryl. One aspect of the disclosure is directed to hydrocarbyl substituted poly(oxyalkylene) monoamines wherein $R_{13}$ is an alkyl group having from 1-10 carbon atoms such as methyl, ethyl, propyl, and butyl. $R_{13}$ may also be selected from the group consisting phenyl, naphthyl, alkylnapthyl, and substituted phenyl having one to three substituents selected from alkyl, aryl, alkylaryl, and arylalkyl. Thus, $R_{13}$ may be phenyl, alkylphenyl, naphthyl and alkylnaphthyl.

In another aspect of the invention, the hydrocarbyl substituted poly(oxyalkylene) monoamines, also referred to herein as the polyether monoamines, may have the formula (II):

(II)

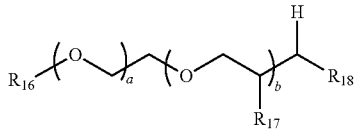

wherein $R_{16}$ is a hydrocarbyl group having from about 1 to about 35 carbon atoms, $R_{17}$ is independently hydrogen or methyl for each repeat unit, $R_{18}$ is hydrogen or a $C_1$-$C_{10}$ alkyl group and a and b are integers such that a+b is from 2 to 45. More preferably, a is an integer of from 1 to 30 and b is an integer of from 1 to 44. In one aspect, the moles of ethylene oxide "EO" is equal to or greater than the moles of propylene oxide "PO".

In one embodiment of the present invention, the polyether monoamines are prepared form ethylene oxide, propylene oxide or combinations thereof. When both ethylene oxide and propylene oxide are used, the oxides can be reacted simultaneously when a random polyether is desired, or reacted sequentially when a block polyether is desired. Generally, when the hydrocarbyl-substituted poly(oxyalkylene) monoamine is prepared from ethylene oxide, propylene oxide or combinations thereof, the amount of ethylene oxide on a molar basis is greater than about 50 percent of the hydrocarbyl-substituted poly(oxyalkylene) monoamine, preferably greater than about 75 percent and more preferably greater than about 85 percent on a molar basis. The hydrocarbyl-substituted poly(oxyalkylene) monoamines used in the practice of this invention can be prepared using well known amination techniques such as described in U.S. Pat. Nos. 3,654,370; 4,152,353; 4,618,717; 4,766,245; 4,960,942; 4,973,761; 5,003,107; 5,352,835; 5,422,042; and 5,457,147. Generally, the hydrocarbyl-substituted poly(oxyalkylene) monoamines are made by aminating a poly(oxyalkylene)alcohol with ammonia in the presence of a catalyst such as a nickel-containing catalyst, for example, Ni/Cu/Cr.

In one aspect, particularly suitable compounds include JEFFAMINE M-600 (approx MW 600 EO/PO-1/9), JEFFAMINE M-1000 (approx MW 1000 EO/PO-19/3), JEFFAMINE M-2070 (approx MW 2000 EO/PO-31/10), and JEFFAMINE M-2005 (approx MW 2000 EO/PO-6/29). Preferred polyether monoamines include JEFFAMINE M-1000 and JEFFAMINE M-2070. The above JEFFAMINE compounds are available from Huntsman Chemicals. More preferred polyether monoamines of the present invention have a molecular weight in the range from about 400 to about 2500. One especially preferred hydrocarbyl-substituted poly(oxyalkylene) monoamine which contains from about 2 to about 35 ethylene oxide units and from 1 to about 10 propylene oxide units.

In one aspect, the monoamine-terminated polyethers have a molecular weight of from about 1,000 g/mol. to about 3,000 g/mol. While the particular JEFFAMINE materials described above are methoxy terminated, the polyether monoamines used in practice of this invention can be capped with any other groups in which the methyl group of the methoxy group is replaced with a longer hydrocarbon such as ethyl, propyl, butyl, etc., including any alkyl substituent which comprises up to about 18 carbons. It is especially preferred that the amine terminating group is a primary amino group.

Certain methanol initiated polyether monoamines have the formula:

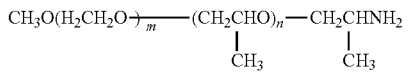

wherein m is about 1 to about 35 and wherein n is about 1 to about 15, in one aspect m>n, including polyether monoamines wherein m is about 15 to about 25 and n is about 2 to about 10.

The mixing of the acylated polyolefin and hydrocarbyl-substituted poly(oxyalkylene) monoamine and, optionally also a polyolefin, may be carried out in a standard mixing apparatus including batch mixers, continuous mixers, kneaders, and extruders. For most applications, the mixing apparatus will be an extruder with grafting and post-grafting derivation accomplished in a two-stage or one-stage process performed in the melt or in solution in a solvent such as a mineral or engine oil. In solution, it is convenient to heat the solution of copolymer intermediate having grafted thereon the carboxylic acid acylating group and the polyether monoamine or mixture of polyether monoamines under inert conditions while mixing under reactive conditions. Typically the solution is heated to about 125° C. to about 175° C. under a nitrogen blanket. The amount of polyether monoamine will typically be on the order of 0.25 to about 2.0 equivalents of amine per carboxylic acid (anhydride) functionality. In one aspect the amount of polyether monoamine will typically be on the order of 0.25 to about 1.50 equivalents of amine per carboxylic acid (anhydride) functionality; in yet another aspect The amount of polyether monoamine will typically be on the order of 0.8 to about 2.0 equivalents of amine per carboxylic acid (anhydride) functionality.

N-Arylphenylene Diamine

The N-arylphenylene diamine of the present disclosure may be represented by the formula (I):

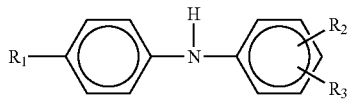

I wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms.

Particularly preferred N-arylphenylenediamines are, for example, N-phenyl-1,4-phenylenediamine, N-phenyl-1,3-phenylendiamine, and N-phenyl-1,2-phenylenediamine. It is preferred that the polyamines contain only one primary amine group so as to avoid coupling and/or gelling of the olefin copolymers.

The reaction between the polymer substrate intermediate having grafted thereon a carboxylic acid acylating functional group n and the polyamine(s) is preferably conducted by heating a solution of the polymer substrate under inert conditions and then adding the polyamine(s) to the heated solution generally with mixing to effect the reaction. It is convenient to employ an oil solution of the polymer substrate heated to 140° C. to 175° C., while maintaining the solution under a nitrogen blanket. The polyamine(s) is added to this solution and the reaction is effected.

Typically, the polyamine compound(s) is (are) dissolved in a surfactant and added to a mineral or synthetic engine oil or solvent solution containing the acylated olefin copolymer. This solution is heated with agitation under an inert gas purge at a temperature in the range of 120° C. to 200° C. as described, for example, in U.S. Pat. No. 5,384,371. The reaction may be carried out in a stirred reactor under nitrogen purge. However, it is also possible to add a surfactant solution of the polyamine compound(s) to zones downstream from the graft reaction-vent zones in a twin screw extruder.

Surfactants which may be used in carrying out the reaction of the acylated olefin copolymer with the polyamine(s) include but are not limited to those characterized as having (a) solubility characteristics compatible with mineral or synthetic engine oil, (b) boiling point and vapor pressure characteristics so as not to alter the flash point of the oil and (c) polarity suitable for solubilizing the polyamine(s). A suitable class of such surfactants includes the reaction products of aliphatic and aromatic hydroxy compounds with ethylene oxide, propylene oxide or mixtures thereof. Such surfactants are commonly known as aliphatic or phenolic alkoxylates. Representative examples are SURFONIC® N-40, N-60, L-24-5, L-46-7 (Huntsman Chemical Company), Neodol® 23-5 and 25-7 (Shell Chemical Company) and Tergitol® surfactants (Union Carbide). Preferred surfactants include those surfactants that contain a functional group, e.g., —OH, capable of reacting with the acylated olefin copolymer.

The quantity of surfactant used depends in part on its ability to solubilize the polyamine(s). Typically, concentrations of 5 to 40 wt. % of surfactant based on the weight of the polyamine(s) are employed. The surfactant can also be added separately, instead of or in addition to the concentrates discussed above, such that the total amount of surfactant in the finished additive is 10 wt. % or less.

Another aspect of the disclosure is directed to a dispersant viscosity index improver composition which may be in the form of a concentrate. In particular, the grafted olefin copolymers are used as dispersant viscosity index improvers for engine oil compositions.

The amount of the viscosity index improver used in the engine oil composition is an amount which is effective to improve or modify the viscosity index of the base oil, i.e., a viscosity improving effective amount. Generally, this amount is from 0.001 wt. % to 20 wt. % for a finished product (e.g., a fully formulated engine oil composition), with alternative lower limits of 0.01 wt %, 0.05 wt. %, 0.1 wt. %, 0.25 wt. %, 1 wt. % or 2 wt. %, and alternative upper limits of 15 wt. % or 10 wt. % or 8 wt. % or 6 wt % or 5 wt % or 4 wt % or 3 wt %. Ranges for the concentration of the VI Improver in the engine oil composition may be made by combining any of the lower limits with any of the foregoing upper limits.

Base Oil

The base oil used in the engine oil compositions herein may be selected from any of the base oils in Groups I-V as specified in the American Petroleum Institute (API) Base Oil Interchangeability Guidelines. The five base oil groups are as follows:

| Base oil Category | Sulfur (%) | | Saturates (%) | Viscosity Index |
|---|---|---|---|---|
| Group I | >0.03 | and/or | <90 | 80 to 120 |
| Group II | ≤0.03 | And | ≥90 | 80 to 120 |
| Group III | ≤0.03 | And | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that when Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed engine oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, engine oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral engine oils, such as liquid petroleum oils and solvent-treated or acid-treated mineral engine oils of the paraffinic, naphthenic or mixed paraffinic-naphthenic types. Such oils may be partially or fully hydrogenated, if desired. Oils derived from coal or shale may also be useful.

Useful synthetic engine oils may include hydrocarbon oils such as polymerized, oligomerized, or interpolymerized olefins (e.g., polybutylenes, polypropylenes, propylene isobutylene copolymers); poly(l-hexenes), poly(l-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic engine oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a engine oil composition may be selected from the group consisting of a Group III base oil, a Group IV base oil, a Group V base oil and mixtures thereof, and wherein the major amount of base oil is other than base oils that arise from provision of additive components or viscosity index improvers in the composition. In another embodiment, the major amount of base oil included in a engine oil composition may be selected from the group consisting of a Group III base oil, a Group IV base oil, or a mixture thereof. The major amount of base oil is other than base oils that arise from provision of additive components or viscosity index improvers in the composition.

The amount of the oil of lubricating viscosity present may be the balance remaining after subtracting from 100 wt. % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

In certain embodiments, a particular selection of the base oil may provide advantageous results in improving wear protection in an engine. For example, in some embodiments, it may be desirable to select a base oil with a SAE Viscosity grade of either 0W-X or 5W-X, wherein X may be selected from the group consisting of 16, 20, 30, or 40. In another embodiment, the base oil may have an SAE viscosity grade of 0W to 5W.

Antioxidants

The engine oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the engine oil composition may contain a mixture of a diarylamine and a high molecular weight phenol, such that each antioxidant may be present in an amount sufficient to provide up to about 5%, by weight, based upon the final weight of the engine oil composition. In an embodiment, the antioxidant may be a mixture of about 0.3 to about 1.5% diarylamine and about 0.4 to about 2.5% high molecular weight phenol, by weight, based upon the final weight of the engine oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt. % to about 5 wt. %, or about 0.01 wt. % to about 5 wt. %, or about 0.1 wt. % to about 3 wt. %, based on the total weight of the engine oil composition.

Antiwear Agents

The engine oil compositions herein also may optionally contain one or more antiwear agents. Examples of suitable antiwear agents include, but are not limited to, a metal thiophosphate; a metal dialkyldithiophosphate; a phosphoric acid ester or salt thereof a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkylthiophosphate. The metal dihydrocarbyldithiophosphates may be present in amount of from 0-6 wt. %, or from 0.1-6 wt. % or from 0.1-4.0 wt. %.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt. % to about 15 wt. %, or about 0.01 wt. % to about 10 wt. %, or about 0.05 wt. % to about 7 wt. %, or about 0.1 wt. % to about 5 wt. % of the engine oil composition.

Boron-Containing Compounds

The engine oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt. %, about 0.01 wt. % to about 7 wt. %, about 0.05 wt. % to about 5 wt. %, or about 0.1 wt. % to about 3 wt. % of the engine oil composition.

Detergents

The engine oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the engine oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The detergent may be present at about 0.1 wt. % to about 15 wt. %, or about 0.2 wt. % to about 8 wt. %, or about 1 wt. % to about 4 wt. %, or greater than about 4 wt. % to about 8 wt. %.

In an embodiment, the engine oil composition comprises one or more calcium containing detergents. In some embodiments, the one or more calcium-containing detergents may be present in an amount to provide from about 900 ppmw to about 2500 ppmw of calcium to the engine oil composition. In another embodiment, the one or more calcium-containing detergents may be present in an amount to provide from about 1000 ppmw to about 2200 ppmw of calcium, or from about 1100 ppmw to about 2000 ppmw of calcium to the engine oil composition.

In another embodiment, the calcium-containing detergent comprises an amount of calcium phenate sufficient to deliver at least 300 ppmw of calcium to the engine oil composition.

In another embodiment, the calcium-containing detergent comprises a mixture of calcium-containing detergents wherein greater than 50% of the mixture is a calcium sulfonate detergent.

Dispersants

The engine oil composition may optionally further comprise one or more dispersants or mixtures thereof. Dispersants are often known as ashless-type dispersants because, prior to mixing in a engine oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range about 350 to about 50,000, or to about 5,000, or to about 3,000. Succinimide dispersants and their preparation are disclosed, for instance in U.S. Pat. No. 7,897,696 or 4,234,435. The polyolefin may be prepared from polymerizable monomers containing about 2 to about 16, or about 2 to about 8, or about 2 to about 6 carbon atoms. Succinimide dispersants are typically the imide formed from a polyamine(s), typically a poly(ethyleneamine).

In an embodiment the present disclosure further comprises at least one polyisobutylene succinimide dispersant derived from polyisobutylene with number average molecular weight in the range about 350 to about 50,000, or to about 5000, or to about 3000. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000 is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment the present disclosure further comprises at least one dispersant derived from polyisobutylene succinic anhydride ("PIMA"). The PIMA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights.

In one embodiment, the dispersant may be derived from a polyalphaolefin (PAO) succinic anhydride.

In one embodiment, the dispersant may be derived from olefin maleic anhydride copolymer. As an example, the dispersant may be described as a poly-PIBSA.

In an embodiment, the dispersant may be derived from an anhydride which is reacted or grafted to an ethylene-propylene copolymer.

A suitable class of dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with:

Inorganic phosphorus acids or anhydrates (e.g., U.S. Pat. Nos. 3,403,102 and 4,648,980);

Organic phosphorus compounds (e.g., U.S. Pat. No. 3,502,677);

Phosphorus pentasulfides;

Boron compounds as already noted above (e.g., U.S. Pat. Nos. 3,178,663 and 4,652,387);

Carboxylic acid, polycarboxylic acids, anhydrides and/or acid halides (e.g., U.S. Pat. Nos. 3,708,522 and 4,948,386);

Epoxides, polyepoxides or thioexpoxides (e.g., U.S. Pat. Nos. 3,859,318 and 5,026,495);

Aldehyde or ketone (e.g., U.S. Pat. No. 3,458,530);

Carbon disulfide (e.g., U.S. Pat. No. 3,256,185);

Glycidol (e.g., U.S. Pat. No. 4,617,137);

Urea, thiourea or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811);

Alkenyl cyanide (e.g., U.S. Pat. Nos. 3,278,550 and 3,366,569);

Diketene (e.g., U.S. Pat. No. 3,546,243);

A diisocyanate (e.g., U.S. Pat. No. 3,573,205);

Alkane sulfone (e.g., U.S. Pat. No. 3,749,695);

1,3-Dicarbonyl Compound (e.g., U.S. Pat. No. 4,579,675);

Sulfate of alkoxylated alcohol or phenol (e.g., U.S. Pat. No. 3,954,639);

Cyclic lactone (e.g., U.S. Pat. Nos. 4,617,138; 4,645,515; 4,668,246; 4,963,275; and 4,971,711);

Cyclic carbonate or thiocarbonate, linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. No. 4,971,598 and British Patent GB 2,140,811);

Hydroxy-protected chlorodicarbonyloxy compound (e.g., U.S. Pat. No. 4,614,522);

Lactam, thiolactam, thiolactone or ditholactone (e.g., U.S. Pat. Nos. 4,614,603 and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);

Combination of a hydroxyaliphatic carboxylic acid and then an aliphatic dicarboxylic acid (e.g., U.S. Pat. No. 4,663,064);

Combination of formaldehyde and a phenol and then glycolic acid (e.g., U.S. Pat. No. 4,699,724);

Combination of a hydroxyaliphatic carboxylic acid or oxalic acid and then a diisocyanate (e.g. U.S. Pat. No. 4,713,191);

Combination of inorganic acid or anhydride of phosphorus or a partial or total sulfur analog thereof and a boron compound (e.g., U.S. Pat. No. 4,857,214);

Combination of an organic diacid then an unsaturated fatty acid and then a nitrosoaromatic amine optionally followed by a boron compound and then a glycolating agent (e.g., U.S. Pat. No. 4,973,412);

Combination of an aldehyde and a triazole (e.g., U.S. Pat. No. 4,963,278);

Combination of an aldehyde and a triazole then a boron compound (e.g., U.S. Pat. No. 4,981,492); and Combination of cyclic lactone and a boron compound (e.g., U.S. Pat. Nos. 4,963,275 and 4,971,711). The above mentioned patents are herein incorporated in their entireties.

The TBN of a suitable dispersant may be from about 10 to about 65 on an oil-free basis, which is comparable to about 5 to about 30 TBN if measured on a dispersant sample containing about 50% diluent oil.

The dispersant, if present, can be used in an amount sufficient to provide up to about 12 wt. %, based upon the final weight of the engine oil composition. Another amount of the dispersant that can be used may be about 0.1 wt. % to about 10 wt. %, or about 0.1 wt. % to about 8.5 wt. %, or about 3 wt. % to about 8 wt. %, or about 1 wt. % to about 6 wt. %, or about 7 wt. % to about 12 wt. %, based upon the final weight of the engine oil composition. In some embodiments, the engine oil composition utilizes a mixed dispersant system. A single type or a mixture of two or more types of dispersants in any desired ratio may be used.

In some embodiments, the engine oil composition further comprises a nitrogen-containing dispersant. In such embodiments, the ratio of total metal from detergents to total nitrogen from dispersants is less than 2.5, or more preferably, less than 2.0.

Friction Modifiers

The engine oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction index improver may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0.01 wt. % to about 5.0 wt. %, or about 0.05 wt. % to about 2 wt. %, or about 0.1 wt. % to about 2 wt. %.

Molybdenum-Containing Component

The engine oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3 SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable—NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

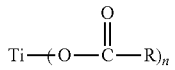

wherein n is an integer selected from 2, 3 and 4, and R is a hydrocarbyl group containing from about 5 to about 24 carbon atoms, or by the formula:

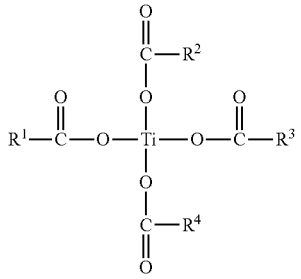

wherein each of $R^1$, $R^2$, $R^3$, and $R^4$ are the same or different and are selected from a hydrocarbyl group containing from about 5 to about 25 carbon atoms. Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the engine oil composition in an amount to provide from 0 to 3000 ppm titanium by weight or 25 to about 1500 ppm titanium by weight or about 35 ppm to 500 ppm titanium by weight or about 50 ppm to about 300 ppm.

Other Optional Additives

Other additives may be selected to perform one or more functions required of a lubricating fluid. Further, one or more of the mentioned additives may be multi-functional and provide functions in addition to or other than the function prescribed herein.

An engine oil composition according to the present disclosure may optionally comprise other performance additives. The other performance additives may be in addition to specified additives of the present disclosure and/or may comprise one or more of metal deactivators, other viscosity index improvers, detergents, ashless TBN boosters, friction modifiers, antiwear agents, corrosion inhibitors, rust inhibitors, dispersants, other dispersant viscosity index improvers, extreme pressure agents, antioxidants, foam inhibitors, demulsifiers, emulsifiers, pour point depressants, seal swelling agents and mixtures thereof. Typically, fully-formulated engine oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt. % to about 5 wt. %, about 0.01 wt. % to about 4 wt. %, or about 0.05 wt. % to about 2.0 wt. % based upon the final weight of the engine oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust or corrosion inhibitor, if present, can be used in an amount sufficient to provide about 0 wt. % to about 2 wt. %, about 0.01 wt. % to about 1 wt. %, about 0.01 wt. % to about 0.5 wt. %, based upon the final weight of the engine oil composition.

In general terms, a suitable crankcase lubricant may include additive components in the ranges listed in the following table.

TABLE 2

| Component | Wt. % (Suitable Embodiments) | Wt. % (Suitable Embodiments) |
|---|---|---|
| Dispersant(s) | 0.1-10.0 | 1.0-8.5 |
| Antioxidant(s) | 0.01-5.0 | 0.1-3.0 |

TABLE 2-continued

| Component | Wt. % (Suitable Embodiments) | Wt. % (Suitable Embodiments) |
|---|---|---|
| Detergent(s) | 0.1-15.0 | 0.2-5.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.1-20.0 | 0.25-13.0 |
| Dispersant viscosity index improver(s) | 0.1-10.0 | 1.0-5.0 |
| Friction modifier(s) | 0.01-5.0 | 0.05-2.0 |
| Base oil(s) | Balance | Balance |
| Total | 100 | 100 |

The percentages of each component above represent the weight percent of each component, based upon the weight of the final engine oil composition. The remainder of the engine oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

Examples

The following examples are illustrative, but not limiting, of the methods and compositions of the present disclosure. In the following Examples, the impact of the incorporation of a dispersant viscosity index improver (DVII) in an engine oil composition on the soot handling, wear protection and sludge handling was determined. The DVII used in these examples was an amine-functionalized olefin copolymer dispersant viscosity index improver comprising the reaction product of an acylated ethylene-propylene copolymer and a polyamine compound as described herein.

Table 3 summarizes the components used in Examples 1-6.

TABLE 3

| Components | 1 | 2 | 3 | 4 (6) | 5 | 6 (7) |
|---|---|---|---|---|---|---|
| Viscosity Grade | 5W-20 | 5W-20 | 0W-20 | 0W-20 | 0W-20 | 0W-20 |
| Total ppm N from dispersants | 760 | 760 | 860 | 850 | 950 | 760 |
| Total ppm Ca from Detergents | 3090 | 1400 | 1370 | 2000 | 1380 | 1350 |
| Total ppm Metal from Detergents | 3090 | 2340 | 1840 | 2000 | 1760 | 1350 |
| ppm P | 800 | 800 | 740 | 800 | 780 | 800 |
| ppm Mo from molybdenum containing additive | 40 | 40 | 100 | 100 | 100 | 100 |
| Dispersant Viscosity Index Improver, wt. % | 0 | 1.0 | 0 | 1.0 | 1.0 | 2.6 |
| Ratio Total Metal from detergents to Total Nitrogen from dispersants | 4.07 | 3.08 | 2.14 | 2.35 | 1.85 | 1.78 |
| Cam Wear Outlet, μm | 94 | 65 | 91 | 46 | 36 | 11 |
| Cam Wear inlet, μm | 76 | 37 | 41 | 49 | 15 | 9 |

TABLE 3-continued

| Components | 1 | 2 | 3 | 4 (6) | 5 | 6 (7) |
|---|---|---|---|---|---|---|
| Piston Cleanliness, merits | 30 | 17 | 13 | 23 | 19 | 31 |
| Sludge, merits | 9.1 | 9.1 | 9.1 | 9.1 | 9.3 | 9.4 |

The engine oils of Examples 1-6 were tested using the OM646LA Wear Test to evaluate wear protection in an engine.

OM646LA Engine Wear Test

The OM646LA Engine wear test is a method of evaluating cam and tappet wear, the bore polish and cylinder wear in an engine. The OM646LA Wear Test employed a 2.2 Liter VTG Turbocharger Direct Injection Four-cylinder diesel, test engine. The engine was subjected to 300 hours of alternating cycles. The results are presented in Table 3 above.

Standard ACEA 2016 A3/B4; C3; C5. The limits used for the OM646LA were ACEA/MB 229.31/51 and VW 508.00/509.00

The ACEA 2016 A3/B4, C3, and C5; MB 229.31/51; and VW 508.00/509.00 limits are included in Table 4 as a reference for the current limits for wear and cleanliness levels in the OM646LA engine wear test.

TABLE 4

| Description | ACEA 2016 A3/B4 | ACEA 2016 C3 & C5 | MB 229.31 | MB 229.51 | VW 508.00/509.00 |
|---|---|---|---|---|---|
| Cam wear outlet, μm | 120 max | 120 max | 130 max | 110 max | 60 max |
| Cam wear inlet, μm | 100 max | 100 max | 100 max | 90 max | 50 max |
| PC, merits | 12 min | 12 min | 14 min | 16 min | 12 min |
| Sludge, merits | 8.8 min | 8.8 min | 8.8 min | 9.1 min | 8.8 min |

In Table 3, Example 2 demonstrated that in a lubricating composition with a viscosity grade of 5W-20, the presence of a small amount of DVII significantly improved the results of the OM646LA engine wear test compared to the similar lubricating composition of Example 1 without the DVII.

Examples 3-6 were blended as 0W-20 oils. In Example 3, DVII was not present. In Example 4, DVII is added and wear performance is improved. Example 5 demonstrates that adding DVII as well as lowering the ratio of metal from detergents to nitrogen from dispersants results in even better improvements in wear. Example 6 included more than twice the amount of DVII and an even lower ratio of metal from detergents to nitrogen from dispersants than Example 5. Example 6's shows even better improvements in wear.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the scope of the appended claims, including the equivalents thereof available as a matter of law. Suitable modifications and adaptations of the variety of conditions and parameters normally encountered in the field, and which are obvious to those skilled in the art, are within the scope of the disclosure.

All patents and publications cited herein are fully incorporated by reference herein in their entirety.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. An engine oil composition comprising:

a) greater than 50 wt. % of a base oil of lubricating viscosity, based on a total weight of the engine oil composition, wherein the base oil is selected from the group consisting of a Group III base oil, a Group IV base oil, a Group V base oil and mixtures thereof;

b) 0.5-5.0 wt. % of a dispersant viscosity index improver, based on a total weight of the engine oil composition, wherein the dispersant viscosity index improver is a reaction product of an olefin copolymer, an acylating agent and a polyamine, wherein the olefin copolymer is a copolymer of ethylene and one or more $C_3$-$C_{28}$ alpha olefins having a number average molecular weight of 30,000 g/mol to 150,000 g/mol;

c) one or more calcium-containing detergents, wherein the one or more calcium-containing detergents provides from about 1000 ppmw to about 2200 ppmw of calcium to the engine oil composition, based on a total weight of the engine oil composition; and d) one or more molybdenum-containing compounds in an amount sufficient to provide from 20 ppm to 550 ppm of molybdenum to the engine oil composition;

e) 0.1 wt. % to 10 wt. % of a nitrogen-containing dispersant, wherein a weight ratio of total metal from detergents to total nitrogen from dispersants is from 1.78 to less than 2.5; and wherein the engine oil composition has an SAE viscosity grade of 0W-X or 5W-X, wherein X=16, 20, 30, or 40; from about 500 ppmw to about 1000 ppmw of phosphorus; and a total sulfated ash content of no greater than 1.2 wt. %, as measured by ASTM D874, both based on a total weight of the engine oil composition, wherein the polyamine is one or more amines selected from the group consisting of:

(a') an N-arylphenylenediamine represented by the formula (I):

I

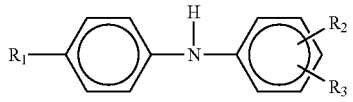

wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms;

(b') an aminothiazole selected from the group consisting of aminothiazole, aminobenzothiazole, aminobenzothiadiazole and aminoalkylthiazole;

(c') an aminocarbazole represented by the formula:

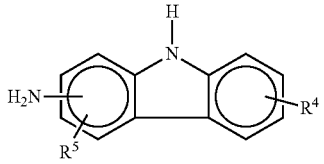

in which $R^4$ and $R^5$ represent hydrogen or an alkyl, alkenyl or alkoxyl radical having from 1 to 14 carbon atoms;

(d') an aminoindole represented by the formula:

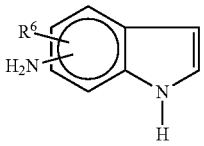

in which $R^6$ represents hydrogen or an alkyl radical having from 1 to 14 carbon atoms;

(e') an aminopyrrole represented by the formula:

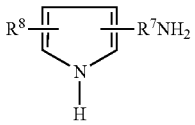

in which $R^7$ is a divalent alkylene radical having 2-6 carbon atoms and $R^8$ is hydrogen or an alkyl radical having from 1 to 14 carbon atoms;

(f') an amino-indazolinone represented by the formula:

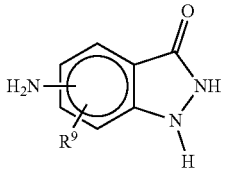

in which $R^9$ is hydrogen or an alkyl radical having from 1 to 14 carbon atoms;

(g') an aminomercaptotriazole represented by the formula:

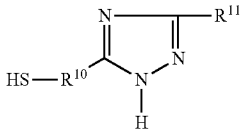

in which $R^{10}$ can be absent or is a $C_1$-$C_{10}$ linear or branched hydrocarbylene selected from the group consisting of alkylene, alkenylene, arylalkylene, or arylene; and $R^{11}$ is hydrogen or a $C_1$-$C_{14}$ alkyl; alkenyl, aralkyl or aryl group;

(h') an aminoperimidine represented by the formula,

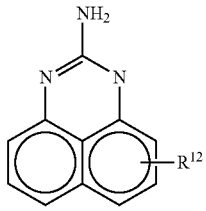

in which $R'^2$ represents hydrogen or an alkyl or alkoxy radical having from 1 to 14 carbon atoms; and (i') an aminoalkyl imidazole.

2. The engine oil composition of claim 1, wherein a ratio of total metal from detergents to total nitrogen from dispersants is less than 2.0.

3. The engine oil composition of claim 1, wherein the one or more calcium-containing detergents provides from about 1100 ppmw to about 2000 ppmw of calcium to the engine oil composition, based on a total weight of the engine oil composition.

4. The engine oil composition of claim 1, wherein the base oil comprises a Group III base oil, a Group IV base oil, or a mixture thereof.

5. The engine oil composition of claim 1, wherein the acylating agent is an ethylenically unsaturated acylating agent having at least one carboxylic acid or carboxylic anhydride group.

6. The engine oil composition of claim 1, wherein the acylating agent is maleic anhydride.

7. The engine oil composition of claim 1, wherein the polyamine is an N-arylphenylene diamine of the formula I:

I

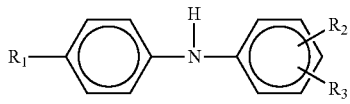

wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms.

8. The engine oil composition of claim 1, wherein the polyamine is selected from the group consisting of N-phenyl-1,4-phenylenediamine, N-phenyl-1,3-phenylendiamine, and N-phenyl-1,2-phenylenediamine.

9. The engine oil composition of claim 1, wherein the copolymer of ethylene and one or more C3-C28 alpha olefins comprises 10-80 wt. % of ethylene and 20-90 wt. % of the one or more C3-C28 alpha olefins.

10. The engine oil composition of claim 1, wherein the copolymer of ethylene and one or more C3-C28 alpha olefins contains 0.14 to 6.86 carboxylic groups per 1000 number average molecular weight units of the polymer backbone.

11. The engine oil composition of claim 1, further comprising one or more components selected from the group consisting of friction modifiers, antiwear agents, antioxidants, antifoam agents, process oil, and pour point depressants.

12. The engine oil composition of claim 1, wherein the engine oil composition does not contain an additional viscosity index improver other than the dispersant viscosity index improver of claim 1.

13. The engine oil composition of claim 1, wherein the engine oil composition does not contain a friction modifier.

14. The engine oil composition of claim 1, wherein the calcium-containing detergent comprises an amount of calcium phenate sufficient to deliver at least 300 ppm of calcium to the engine oil composition, based on a total weight of the engine oil composition.

15. The engine oil composition of claim 1, wherein the calcium-containing detergent comprises a mixture of calcium-containing detergents wherein greater than 50% of the mixture of detergents is a calcium sulfonate detergent.

16. The engine oil composition of claim 1, comprising from about 0.1 wt. % to about 5 wt. % of the dispersant viscosity index improver, based on the total weight of the engine oil composition.

17. A method for improving wear protection in an engine comprising a step of lubricating said engine with an engine oil composition comprising:

greater than 50 wt. % of a base oil of lubricating viscosity; and an additive composition including:

a) 0.5-5.0 wt. % of a dispersant viscosity index improver, based on a total weight of the engine oil composition, wherein the dispersant viscosity index improver is the reaction product of an olefin copolymer and an acylating agent and a polyamine, wherein the olefin copolymer is a copolymer of ethylene and one or more C3-C28 alpha olefins having a number average molecular weight of 30,000 g/mol to 150,000 g/mol; and b) one or more calcium-containing detergents, wherein the one or more calcium-containing detergents provides from 1000 ppmw to 2200 ppmw of calcium to the engine oil composition;

c) one or more molybdenum-containing compounds in an amount sufficient to provide from 20 ppm to 550 ppm of molybdenum to the engine oil composition;

d) 0.1 wt. % to 10 wt. % of a nitrogen-containing dispersant, wherein a ratio of total metal from detergents to total nitrogen from dispersants is from 1.78 less than 2.5; and wherein the engine oil composition has an SAE viscosity grade of 0W or 5W, from about 50 ppmw to about 1000 ppmw of phosphorus, and a total sulfated ash content of no greater than 1.2 wt. %, as measured by ASTM D874, both based on the total weight of the engine oil composition, wherein the polyamine is one or more amines selected from the group consisting of:

(a') an N-arylphenylenediamine represented by the formula (I):

I

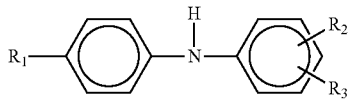

wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms;

(b') an aminothiazole selected from the group consisting of aminothiazole, aminobenzothiazole, aminobenzothiadiazole and aminoalkylthiazole;

(c') an aminocarbazole represented by the formula:

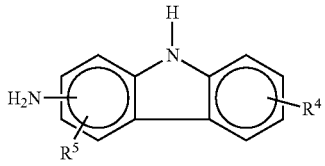

in which $R^4$ and $R^3$ represent hydrogen or an alkyl, alkenyl or alkoxyl radical having from 1 to 14 carbon atoms;

(d') an aminoindole represented by the formula:

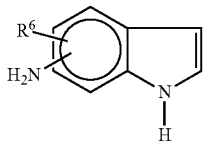

in which $R^6$ represents hydrogen or an alkyl radical having from 1 to 14 carbon atoms;

(e') an aminopyrrole represented by the formula:

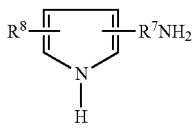

in which $R^7$ is a divalent alkylene radical having 2-6 carbon atoms and $R^8$ is hydrogen or an alkyl radical having from 1 to 14 carbon atoms;

(f') an amino-indazolinone represented by the formula:

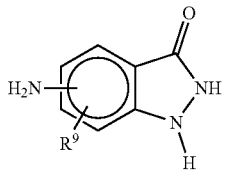

in which $R^9$ is hydrogen or an alkyl radical having from 1 to 14 carbon atoms;

(g') an aminomercaptotriazole represented by the formula:

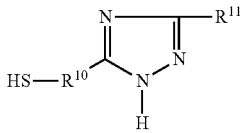

in which $R^{10}$ can be absent or is a $C_1$-$C_{10}$ linear or branched hydrocarbylene selected from the group consisting of alkylene, alkenylene, arylalkylene, or arylene; and $R^{11}$ is hydrogen or a $C_1$-$C_{14}$ alkyl, alkenyl, aralkyl or aryl group;

(h') an aminoperimidine represented by the formula,

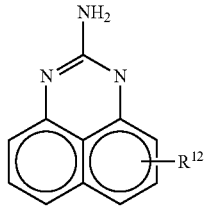

in which $R^{12}$ represents hydrogen or an alkyl or a alkoxy radical having from 1 to 14 carbon atoms; and (i') an aminoalkyl imidazole.

18. A method of operating an engine comprising steps of:

lubricating the engine with an engine oil composition comprising:

greater than 50 wt. % of a base oil of lubricating viscosity, based on a total weight of the engine oil composition; and an additive composition including:

a) 0.5-5.0 wt. % of a dispersant viscosity index improver, based on a total weight of the engine oil composition, wherein the dispersant viscosity index improver is the reaction product of an olefin copolymer and an acylating agent and a polyamine, wherein the olefin copolymer is a copolymer of ethylene and one or more $C_3$-$C_{28}$ alpha olefins having a number average molecular weight of 30,000 g/mol to 150,000 g/mol; and b) one or more calcium-containing detergents, wherein the one or more calcium-containing detergents provides from 1000 ppmw to 2200 ppmw of calcium to the engine oil composition, based on a total weight of the engine oil composition;

c) one or more molybdenum-containing compounds in an amount sufficient to provide from 20 ppm to 550 ppm of molybdenum to the engine oil composition;

d) 0.1 wt. % to 10 wt. % of a nitrogen-containing dispersant, wherein a ratio of total metal from detergents to total nitrogen from dispersants is from 1.78 to less than 2.5; and wherein the engine oil composition has an SAE viscosity grade of 0W or 5W, from about 50 ppmw to about 1000 ppmw of phosphorus, and a total sulfated ash content of no greater than 1.2 wt. %, as measured by ASTM D874, both based on a total weight of the engine oil composition; and operating the engine, wherein the polyamine is one or more amines selected from the group consisting of:

(a') an N-arylphenylenediamine represented by the formula (I):

I

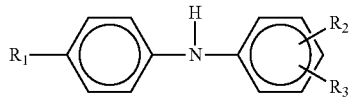

wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms;

(b') an aminothiazole selected from the group consisting aminothiazole, aminobenzothiazole, aminobenzo-thiadiazole and aminoalkylthiazole;

(c') an aminocarbazole represented by the formula:

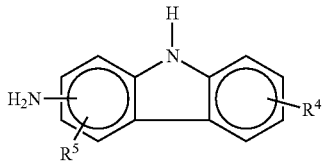

in which $R^4$ and $R^5$ represent hydrogen or an alkyl, alkenyl or alkoxyl radical having from 1 to 14 carbon atoms;

(d') an aminoindole represented by the formula:

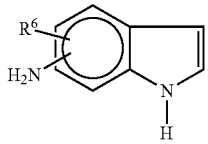

in which $R^6$ represents hydrogen or an alkyl radical having from 1 to 14 carbon atoms;

(e') an aminopyrrole represented by the formula:

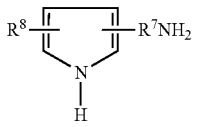

in which $R^7$ is a divalent alkylene radical having 2-6 carbon atoms and $R^8$ is hydrogen or an alkyl radical having from 1 to 14 carbon atoms;

(f') an amino-indazolinone represented by the formula:

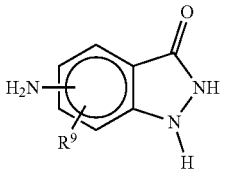

in which $R^9$ is hydrogen or an alkyl radical having from 1 to 14 carbon atoms;

(g') an aminomercaptotriazole represented by the formula:

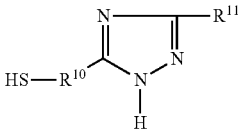

in which $R^{10}$ can be absent or is a $C_1$-$C_{10}$ linear or branched hydrocarbylene selected from the group consisting of alkylene, alkenylene, arylalkylene, or arylene; and $R^{11}$ is hydrogen or a $C_1$-$C_{14}$ alkyl, alkenyl, aralkyl or aryl group;

(h') an aminoperimidine represented by the formula,

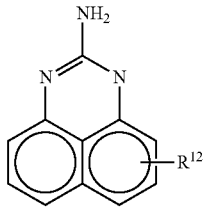

in which $R'^2$ represents hydrogen or an alkyl or alkoxy radical having from 1 to 14 carbon atoms; and (i') an aminoalkyl imidazole.

19. The engine oil composition of claim 1, wherein the one or more molybdenum-containing compounds provides at least 40 ppm of molybdenum to the engine oil composition.

20. The engine oil composition of claim 1, wherein the aminoalkyl imidazole is 1-(2-aminoethyl) imidazole or 1-(3-aminopropyl) imidazole.

21. The method of claim 17, wherein the aminoalkyl imidazole is 1-(2-aminoethyl) imidazole or 1-(3-aminopropyl) imidazole.

22. The method of claim 18, wherein the aminoalkyl imidazole is 1-(2-aminoethyl) imidazole or 1-(3-aminopropyl) imidazole.

* * * * *